United States Patent [19]

Beavers

[11] 4,285,354

[45] Aug. 25, 1981

[54] MULTIPURPOSE TENT

[75] Inventor: Allan E. Beavers, Littleton, Colo.

[73] Assignee: T. A. Pelsue Company, Englewood, Colo.

[21] Appl. No.: 31,017

[22] Filed: Apr. 17, 1979

[51] Int. Cl.[3] ..... A45F 1/00

[52] U.S. Cl. ..... 135/1 R; 135/3 R; 135/5 R; 135/DIG. 9

[58] Field of Search ..... 135/1 R, 3 R, 4 R, 5 R, 135/7.1 R, DIG. 9; 404/25

[56] References Cited

U.S. PATENT DOCUMENTS

| | | | |
|---|---|---|---|
| 2,185,588 | 1/1940 | Datz | 135/4 R |
| 3,407,825 | 10/1968 | Doyle | 135/5 R |
| 3,441,037 | 4/1969 | Transeau | 135/1 R |
| 3,444,793 | 5/1969 | Pelsue | 404/25 |
| 3,525,290 | 8/1970 | Pelsue | 135/1 R |
| 3,550,601 | 12/1970 | Peters | 135/7.1 R |
| 3,810,482 | 5/1974 | Beavers | 135/DIG. 9 |
| 4,077,417 | 3/1978 | Beavers | 135/3 R |

FOREIGN PATENT DOCUMENTS

| | | | |
|---|---|---|---|
| 327552 | 3/1958 | Switzerland | 135/DIG. 9 |

*Primary Examiner*—J. Karl Bell

*Attorney, Agent, or Firm*—Edwin L. Spangler, Jr.

[57] ABSTRACT

This invention relates to a tent consisting of an open-bottomed roofed canopy and foldable frame having cornerposts detachably connectable to various socketed supporting structures cooperating therewith to define an aerial tent, a tent for a cherry picker bucket and a ground tent for use in covering the entryway through a manhole to an underground installation. The support subassembly adapting the tent for use as an aerial tent includes vise-like cable clamps detachably connectable to an overhead cable, upwardly divergent sockets for receiving the cornerposts of the frame and ties for connecting the canopy to supports positioned above the cable. A second support subassembly provides socketed arms depending from a cherry picker bucket that detachably receive the tent frame cornerposts. The latter subassembly includes a high voltage version wherein the arms are detachably secured to the bucket without penetrating same by means of a belted sling.

2 Claims, 7 Drawing Figures

MULTIPURPOSE TENT

Tents of one type or another specifically designed for use as a means for protecting service personnel working out-of-doors in cold or otherwise inclement weather while servicing or installing underground electrical cable, overhead power lines and similar equipment located either above or below ground are well known in the art, one example being the tent forming the subject matter of U.S. Pat. No. 3,525,290. Generally speaking, an ordinary tent will prove unsatisfactory for such applications, primarily because there is no practical way of anchoring it to an available supporting surface. For instance, when being used to shield an open manhole from the elements, staking the canopy down to concrete or asphalt pavement when such installations are found is next to impossible. Aerial tents present an even greater problem since there is no ground at all available, only cables, wires and an occasional telephone pole or transmission line tower. All too often, the time these out-of-door public utilities need service the most is during the worst weather.

Aerial tents anchored to telephone poles are old and well known; however, to applicant's knowledge there is only one other so-called "strand tent" available and it is a large cumbersome arrangement with several arched frame-forming bows covered by a canopy that results in a unit resembling an old Conestoga wagon on a miniature scale. While it mounts to a cable as does the tent of the instant invention, the way in which this is done and the support hardware are quite different.

Providing a canopy or awning of some type over an occupant of a cherry picker bucket is probably something that has been done before although applicant has no particular knowledge concerning such a unit if one does, in fact, exist. The novelty in the instant tent does not lie in the combination of the tent and the several existing pieces of equipment it can be used with, but instead, to the tent and the unique mounting hardware by means of which it is detachably, or in one instance more or less permanently, fastened to this equipment, particularly the overhead cable and cherry picker bucket.

Most equipment used in the installation and/or service of out-of-door telephone lines, power lines, underground cables and similar facilities is carried on some sort of service truck. The same truck may function as a mobile base for servicing both underground and above ground installations and, for this reason, the equipment should, if possible, be versatile enough in design to do both. Also, the equipment should be capable of being set up and taken down quickly since in most instances it must be erected each morning and taken down each night. While weight and compactness are not the factors they are in, say, a backpacker's tent, they are nonetheless significant because they must be stowed on a vehicle where space is at a premium and often hoisted to overhead power lines.

The instant multipurpose tent answers all these needs and more. It is just as useful covering an open manhole as it is hanging from an overhead cable or riding up and down on a cherry picker bucket. The frame and canopy are connected together to define a unitary structure that can be folded in an instant into a compact bundle of struts, posts and fabric for easy stowage. Conversely, when unfolded it provides a roomy and weatherproof shelter. Tightening two vise-like clamps with a screwdriver blade or other torquing tool and anchoring one or more corners of the canopy to an overhead support complete the installation of the unit as an aerial tent. In the case of a cherry picker bucket, for low voltage applications where the bucket can be drilled, the supporting hardware can be attached permanently and left in place even though the canopy and frame are not being used. A less permanent, but nonetheless equivalent sling-type mount can be left in place on the bucket used for work adjacent high voltage lines, all without having to drill the bucket. In both instances, once the roof frame is snapped open, it becomes a mere matter of slipping the four cornerposts into their sockets to complete the erection of the tent.

It is, therefore, the principal object of the present invention to provide a novel and improved multipurpose tent especially suited for use as a protective cover for workmen servicing overhead and underground facilities located out-of-doors.

A second objective is the provision of a device of the class described which is equally well adapted for use as a ground tent over an open manhole, as a canopy over an open cherry picker bucket or as an aerial tent hanging from an overhead cable.

Another object is to provide an aerial tent which upon attachment to a single cable running through the center thereof remains in a stable upright position so long as the sides of the canopy are down.

Still another object is the provision of a tent-like frame-supported canopy for cherry picker buckets which for high voltage applications is fitted with mounting hardware requiring no penetration of the bucket.

An additional objective is to provide a tent of the type aforementioned that can be folded and unfolded essentially instantaneously using frame hardware of the same general type found in assignee's patented ground tent (U.S. Pat. No. 4,077,417).

Further objects are to provide a tent structure which is simple, compact, rugged, versatile, easy to use, lightweight and decorative.

Other objects will be in part apparent and in part pointed out specifically hereinafter in connection with the description of the drawings that follows, and in which.

Figure 1:
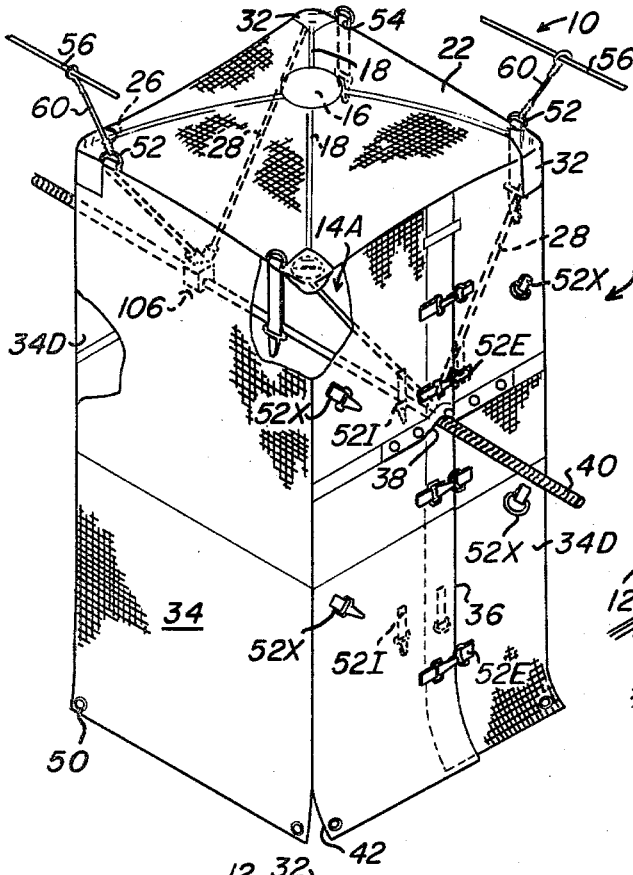
FIG. 1 is a perspective view showing the tent of the present invention being used as a strand tent hanging upon an overhead cable, portions of the canopy having been broken away to expose the interior construction.
Figure 2:
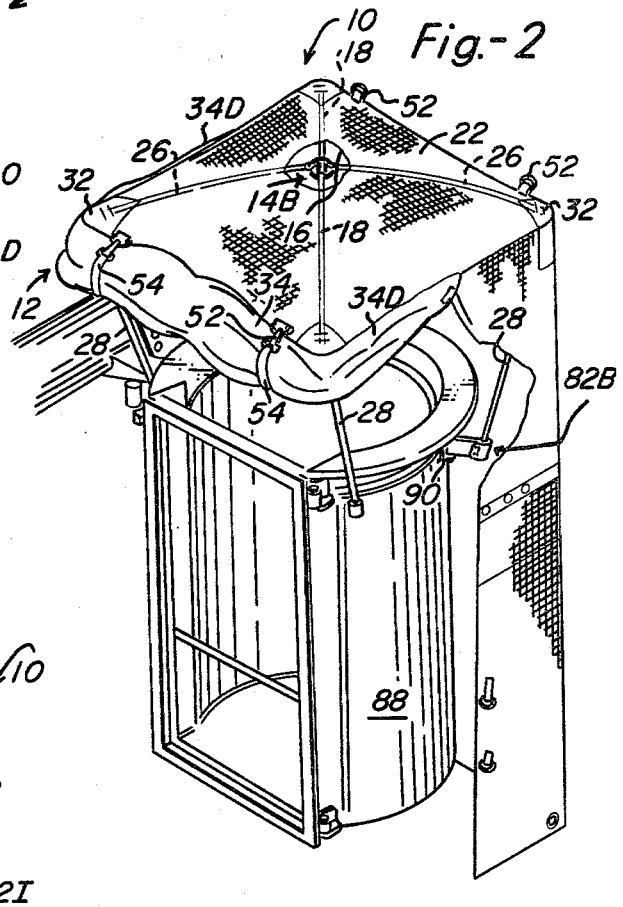
FIG. 2 is a perspective view similar to FIG. 1 and to the same scale but showing the tent with one flap raised used as a canopy over a cherry picker bucket, portions of the canopy again having been removed to better reveal the interior.
Figure 3:
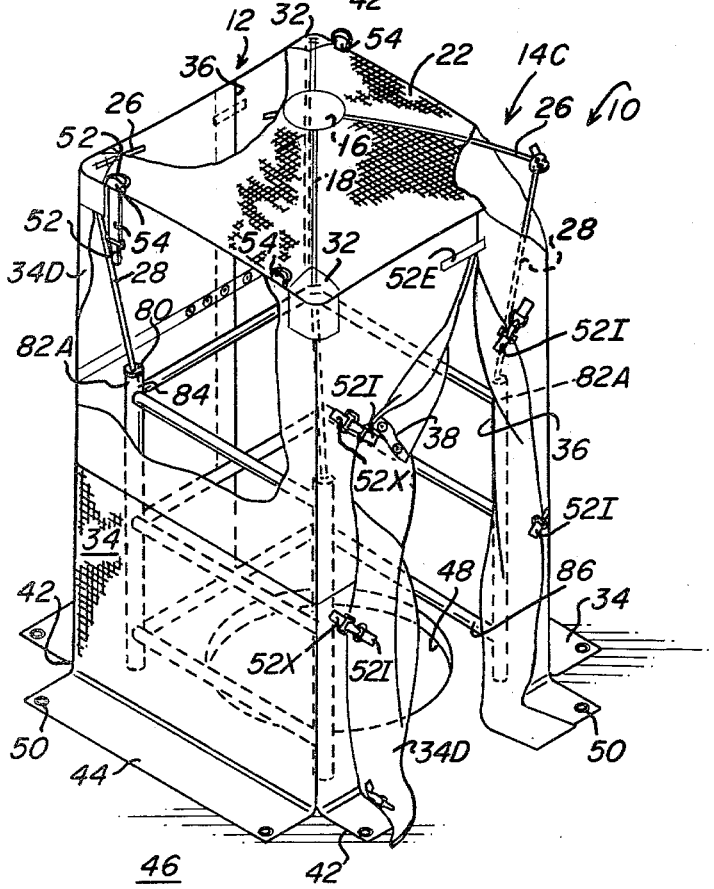
Figures 4, 5, 6, 7:
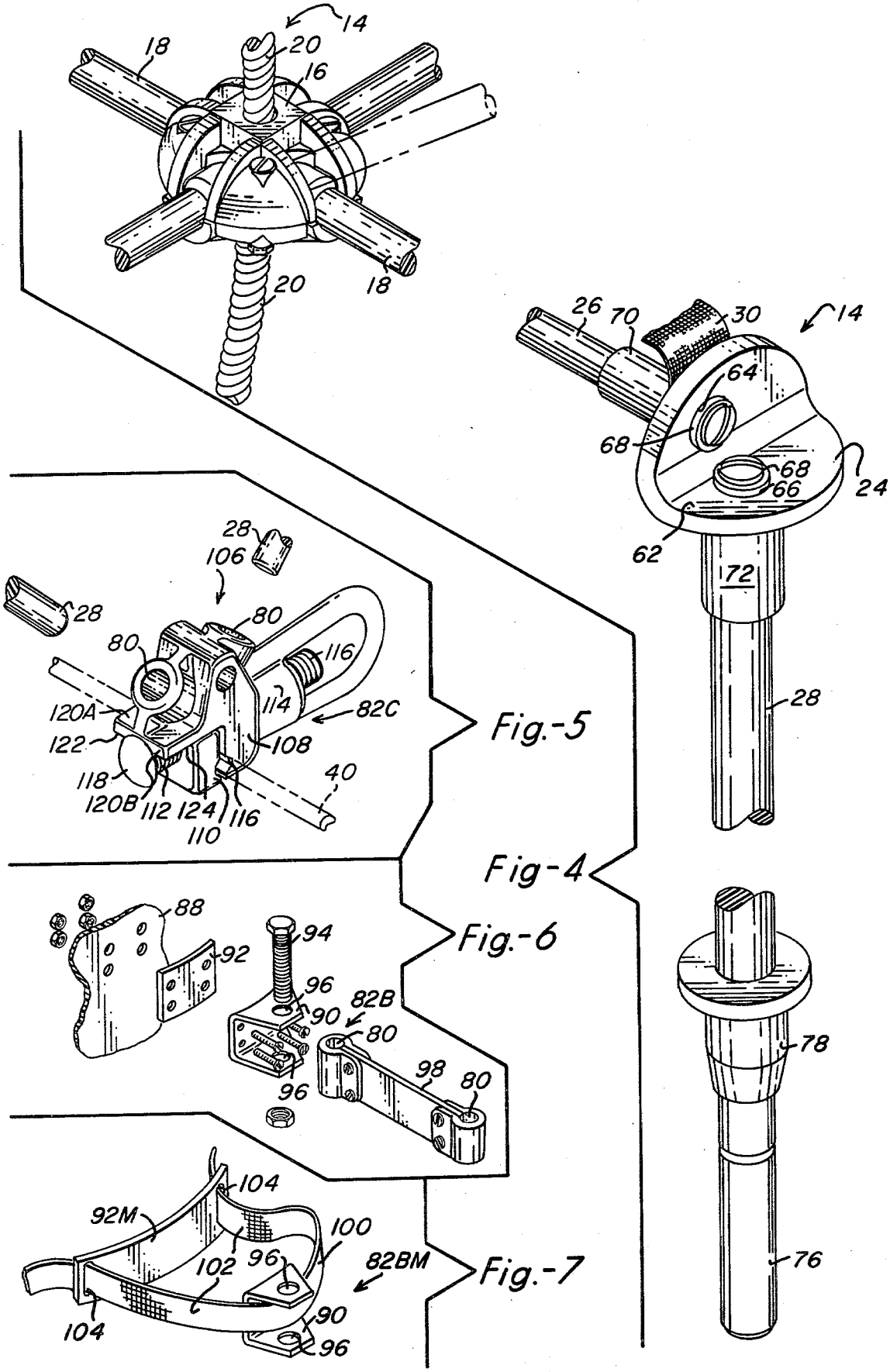

FIG. 3 is still another perspective view like FIGS. 1 and 2 but this time showing the tent in use as a protective covering over an open manhole much in the manner of U.S. Pat. No. 3,525,290, parts of the cover once again being broken away for the same purpose as before;

FIG. 4 is an exploded fragmentary view to a greatly enlarged scale showing the tent canopy frame, portions of the roof struts and cornerposts having been broken away to conserve space;

FIG. 5 is an exploded fragmentary view to the same scale as FIG. 4 showing the cable clamps adapting the frame for use as a strand tent;

FIG. 6 is an exploded fragmentary view to a somewhat reduced scale compared with FIGS. 4 and 5 showing the permanent mounting hardware for mounting the tent on a cherry picker bucket designed for use on low voltage transmission lines; and FIG. 7 is an exploded view to the same scale as FIG. 6 showing a modified form of bucket-mounting hardware especially suited for use where the bucket is intended for use adjacent high voltage transmission lines and, for this reason, should not be punctured.

Referring next to the drawings for a detailed description of the present invention and, initially, to FIGS. 1, 2 and 3 for this purpose, reference numeral 10 has been chosen to designate the tent in a general way while numerals 12 and 14 similarly denote its canopy and frame, respectively. Frame 14 has three different forms (14A, 14B and 14C) each of which contains structures common to all three forms and some different structures which adapt it to a particular use, i.e. to shield the entry through a manhole to an underground installation (FIG. 3), as a roof over the occupant of a "cherry picker" bucket (FIG. 2) and as a so-called "strand tent" for aerial work on overhead power lines and the like (FIG. 1). Each of the three frames includes a central hub 16, a set of four roof supporting struts 18, a rope 20 connecting the hub to the roof 22 of the canopy (FIG. 4), corner connectors 24 for connecting the remote ends 26 of the roof struts to the cornerposts 28, the cornerposts just mentioned, and straps 30 for detachably connecting the corner connectors to the reinforced corners 32 of the canopy roof.

Roof 22 of the canopy 12 is, in the particular form shown, essentially square and rectangular side panels 34 hang down from its marginal edges to define sidewalls. Two of the four panels are plain while the other two 34D are both centrally slit from top to bottom and overlapped to define opposed entryways 36. Panels 34D lie opposite one another and also include horizontal slits 38 intersecting the vertical slits 36 somewhat above halfway up the panel but not extending all the way across. The latter slits are horizontally aligned and they allow the tent-supporting strand 40 to pass therethrough when the tent is used as an aerial tent in the manner shown in FIG. 1. The preferred location of horizontal slots 38 is well over halfway up such that the center of mass of the tent falls underneath the supporting cable and it will hang freely in upright condition when the sides are down as in FIG. 1.

The side margins of the panels 34 are joined together except for a short slit 42 at the bottom edge. This slit frees flaps 44 which lay out horizontally on the pavement 46 bordering the manhole 48 where the tent is used in the manner shown in FIG. 3 as a cover over the latter. Grommets 50 are provided in the corners of the flaps to receive tie downs (now shown) should the latter be required in windy weather.

The overlapped portions of the panels 34D adjacent entryway slit 36 are secured in overlapped relation by two-part fasteners 52, the particular ones shown comprising conventional snap fasteners and D-rings each attached to a short section of web strapping sewn or otherwise attached to the panel. The significant thing to note about these fasteners is not their construction which is well known, but rather, the fact that each panel 34D includes an interior set 52I, an exterior set 52E and still another set 52X, the purpose of which will be explained presently. A workman on the ground leaving the tent will open the interior set to get out and find the exterior set already open. Conversely, when entering the tent, the exterior set will be opened and the interior set closed once inside. At times, of course, both sets will be closed on one or both of the panels when, for example, it is being used as an aerial tent like in FIG. 1 where it is entered from underneath by a ladder (not shown).

In FIGS. 1 and 3 it can be seen that each of the entry panels 34D is also preferably equipped with the third set of fasteners 52X which do not interconnect with one another but instead are arranged in widely-spaced relation adjacent opposite side margins of the panel in position to receive the mating element of interior set 52I. As shown, the D-rings of the extra set are arranged in a vertical row to the right of the entryway in position to receive the snap fasteners of the interior set when the right-hand flap is opened. Similarly, the extra set of snap fasteners to the left of the entryway fasten onto the D-rings of the inner set and hold the left flap open.

Now, on occasion, the workmen need overhead protection from the sun yet prefer the side panels to be raised for ventilation. Entryway slits 36 effectively divide the canopy into two halves either or both of which can be rolled up independently of the other in the manner shown in FIG. 2. In order to hold these flaps in rolled condition, straps 54 are provided. In the particular form shown, these straps hang down inside the tent adjacent the four corners thereof along plain panels 34. Exposed on the roof of the tent is the D-ring element of the snap fastener subassembly 52 while the end of the strap inside the tent carries the snap part (see FIG. 3). Now, as the sides of the canopy are rolled up as shown in FIG. 2, the straps 54 become exposed and can be brought around the roll thus formed and the two parts of the fastener subassembly 52 connected together.

In FIG. 1, it can be seen that the D-ring part of these same snap fastener subassemblies exposed on the roof 22 of the canopy serve yet another function, namely that of providing a means for fastening the top of the tent to whatever is available in the way of overhead supports 56 when the tent is being used as an aerial tent. Ordinarily when so used, there will be an abundance of wires and cables overhead to which ties 60 can be run from the nearest D-rings. Also, while the tent is stable in the upright position with its sides down, it is not with them rolled up thus necessitating additional anchoring means. Also, even with the sides down, the tent would be unstable in high winds if not anchored to something besides cable 40.

Turning next to FIGS. 4–7, inclusive, some of the hardware details will be set forth. First with respect to FIG. 4, the hub and strut subassembly 16, 18 is not substantially different from that shown in FIGS. 6 and 7 of assignee's U.S. Pat. No. 4,077,417 except that the cord goes through the center of the hub rather than being offset to one side thereof. The struts 18 are flexible and snap into an arched configuration as shown in FIGS. 1, 2 and 3 just the same way as is fully described in the Pelsue Co. patent referred to above. A downward pull on the hub collapses the roof-supporting subassembly and leaves the roof 22 of the canopy folded inside the strut package as indicated by phantom lines in FIG. 4.

In the same figure, it can be seen that corner connector 24 comprises basically a circular disk 62 folded diametrically until the halves thereof assume a right angular relation. Apertures 64 and 66 in these halves along with grommet-encircled apertures (not shown) in straps 30 receive the necked-down ends 68 of tubular sockets 70 and 72. These sockets, in turn, receive the remote ends 26 of roof struts 18 and the upper ends 74 of cornerposts 28.

The lower ends 76 of cornerposts 28 are each fitted with flanged collars 78. These collars define stops effective to limit the penetration of the lower cornerpost ends 76 lift projecting therebeneath into the tubular sockets 80 in the support hardware 82 which will presently be described in detail in connection with FIGS. 3, 5, 6 and 7.

Referring once again to FIG. 3, the simplest of the three support systems 82A will be seen to comprise the uprights 84 of manhole guardrail 86. This guardrail forms the subject matter of U.S. Pat. No. 3,444,793 to which reference should be made for the details of its construction. For present purposes, it will suffice to point out that the hollow tubular uprights 84 at the corners of the guardrail receive the lower ends 76 of the cornerposts 28 of the frame 14 in much the same manner as the spring bows 48 in U.S. Pat. No. 3,525,290. The latter patent relates to a different type of cover for the manhole but the end result remains the same. Flanged plug 78 of the instant frame replaces plug 54 of the patented one.

The second of the support subassemblies 84B is that which is shown in FIGS. 2 and 6 to which specific reference will next be made. Basically, it comprises a bracket and arm subassembly permanently attached to conventional cherry picker bucket 88 at four locations spaced around its periphery. These buckets can be of various shapes, the most common being either round like the one illustrated or square.

In low voltage applications, a channel-shaped bracket 90 is bolted to the bucket wall near the rim bordering the top edge thereof, preferably with a pad of insulating material 92 therebetween as shown in FIG. 6. A nest and bolt subassembly defining a pivot pin 94 passes through vertically-aligned apertures 96 in the parallel flanges of the bracket and mounts arm 98 for pivotal movement from side to side. Both ends of arm 98 are provided with sockets 80, the one on the inner end to receive the pivot pin 94 and the one on the outer end to receive the lower end 76 of tent frame cornerpost 28. Altogether, four such arms are provided, each positioned to receive one of the cornerposts 28 at the corner of the canopy roof 22, all of which have been clearly revealed in FIG. 2.

FIG. 2 shows the low voltage installation using the mounting hardware 82B of FIG. 6; however, a modified form of this bucket mounting hardware 82BM preferred for high voltage applications is shown in FIG. 7 to which brief reference will now be made. In this instance, the bracket 90, arm 98 and its sockets 80 remain the same as does pivot pin 94; however, instead of bolting bracket 90 to the side of the bucket, it is strapped thereto using belt 100. A buckle of some type (not shown) is used to tighten the belt securely around the rim of the bucket with portions 102 of the strap passing through the channel in the four brackets and holding them snugly against modified insulators 92M each of which is slotted at opposite ends 104 to receive the bracket-retaining portions 102 of the belt. The sling-type support hardware 82BM just described is preferred in those high voltage applications where safety demands that no holes be drilled in the bucket.

Finally, with specific reference to FIGS. 1 and 5, the particular support subassembly 82C used to mount the tent frame 14 on a single strand cable 40 will be set forth in detail. In this instance, two of the cornerposts 28 are received in the sockets 80 of a single cable clamp indicated in a general way be reference numeral 106. In the particular form shown, this clamp has a fixed jaw 108 and a movable jaw 110 held in assembled clamp-forming relation by a screw 112 and a handle element 114. These jaws have opposed horizontally-disposed V-shaped grooves 116 sized to receive the cable 40. The threaded shank 116 of the screw is threaded through the movable jaw but left free to turn in the fixed one. Handle 114 is non-rotatably secured to the threaded shank 116 of the screw by a set screw (not shown). The fixed jaw includes oppositely-facing fixed abutments 120A and 120B that are engaged, respectively, by the head 118 of the screw and the handle 114 used to rotate the latter. As the screw is turned by handle 114, the movable jaw 110 opens and closes in vise-like fashion relative to the fixed one. Fixed abutment 120A provides a ledge 122 overhanging the movable jaw 110 and cooperating with its opposed upwardly-facing flat surface 124 to prevent the latter from turning. Lastly, handle 114 is shown to include an integral tool-receiving yoke 126 defining an eye for the reception of a torquing tool to assist in tightening the clamp on the cable.

What is claimed is:

1. The tent comprising: a rectangular roof panel and four rectangular side panels hanging from the edges of the roof panel and cooperating therewith and with one another to define an open-bottomed box-like canopy, one opposed pair of said side panels being vertically slit intermediate the side margins thereof to free openable flaps arranged in side-by-side relation, and each side panel of the remaining pair thereof cooperating with the adjacent flaps to produce an elevatable curtain; a rigid subframe including connecting means located on the inside of the canopy at the juncture between adjacent side panels and the roof panel, a hub member positioned on the underside of the roof panel at the center thereof, struts radiating diagonally from the hub to points of attachment with the connecting means, and upright cornerposts connected to the connecting means in essentially right-angular relation to the struts connected thereto; and means comprising a base detachably connectable to the cornerposts in supporting relation to the latter, said base comprising a sling including a belt detachably connectable to a personnel-carrying bucket of a cherry picker in encircling relation thereof, and socket like elements carried by said belt for receiving the free ends of the connecting means.

2. The tent as set forth in claim 1 wherein the base comprises clamp means clampable onto an overhead cable passing through the slits in the first of the opposed pairs of side panels, said clamp means including cornerpost receptors positioned and adapted to receive the unattached ends of an adjacent pair of said cornerposts and support same in upwardly-divergent V-shaped relation.

* * * * *